US008786509B2

(12) United States Patent
Johnson

(10) Patent No.: US 8,786,509 B2
(45) Date of Patent: Jul. 22, 2014

(54) MULTI POLARIZATION CONFORMAL CHANNEL MONOPOLE ANTENNA

(75) Inventor: Richard S. Johnson, Melissa, TX (US)

(73) Assignee: Raytheon Company, Waltham, MA (US)

( * ) Notice: Subject to any disclaimer, the term of this patent is extended or adjusted under 35 U.S.C. 154(b) by 927 days.

(21) Appl. No.: 12/725,225

(22) Filed: Mar. 16, 2010

(65) Prior Publication Data

US 2011/0227793 A1 Sep. 22, 2011

(51) Int. Cl.
*H01Q 1/42* (2006.01)
*H01Q 1/38* (2006.01)

(52) U.S. Cl.
USPC ..... 343/789; 343/700 MS

(58) Field of Classification Search
USPC ..... 343/700 MS, 702, 846, 850, 853, 343/725–729, 797, 789
See application file for complete search history.

(56) References Cited

U.S. PATENT DOCUMENTS

| | | | | |
|---|---|---|---|---|
| 3,971,032 | A * | 7/1976 | Munson et al. | 343/770 |
| 4,710,775 | A * | 12/1987 | Coe | 343/727 |
| 5,784,032 | A | 7/1998 | Johnston et al. | |
| 6,407,711 | B1 | 6/2002 | Bonebright et al. | |
| 6,995,712 | B2 * | 2/2006 | Boyanov | 343/700 MS |
| 7,098,853 | B2 | 8/2006 | McGrath et al. | |
| 7,619,568 | B2 * | 11/2009 | Gillette | 343/700 MS |
| 8,289,223 | B2 * | 10/2012 | Fonseca et al. | 343/846 |
| 2003/0020655 | A1 * | 1/2003 | McKinzie et al. | 343/700 MS |
| 2008/0012779 | A1 * | 1/2008 | Chen et al. | 343/850 |

FOREIGN PATENT DOCUMENTS

| | | |
|---|---|---|
| CN | 101 483 277 A | 7/2009 |
| EP | 1 619 755 A1 | 1/2006 |
| FR | 2 565 417 | 12/1985 |

OTHER PUBLICATIONS

Extended European Search Report for European Application No. 11154501.8, Applicant Raytheon Company, European Search Report dated Jun. 10, 2011 and mailed Jun. 20, 2011 (4 pgs.).
Communication Pursuant to Article 94(3) EPC for European Application No. 11154501.8, Applicant Raytheon Company, European Communication mailed Apr. 4, 2012 (5 pgs.).

* cited by examiner

*Primary Examiner* — Michael C Wimer
*Assistant Examiner* — Hasan Islam
(74) *Attorney, Agent, or Firm* — Christie, Parker & Hale, LLP

(57) ABSTRACT

A conformal channel monopole antenna system includes: a housing; a cavity formed within the housing; and a substrate covering the cavity. The substrate includes a first elongated radiating element coupled to two opposing sides of the top surface of the housing at two opposing ends in a first direction; a second elongated radiating element coupled another two opposing sides of the top surface of the housing at two opposing ends in a second direction orthogonal to the first direction; a first feed port at one end of the first elongated radiating element; and a second feed port at one end of the second elongated radiating element. The first elongated radiating element is configured to radiate a first type of polarization and the second elongated radiating element is configured to radiate a second type of polarization simultaneously with the first type of polarization.

13 Claims, 9 Drawing Sheets

MULTI POLARIZATION CONFORMAL CHANNEL MONOPOLE ANTENNA

FIELD OF THE INVENTION

The present invention relates generally to antennas and more specifically to a multi polarization conformal channel monopole antenna.

BACKGROUND

An antenna is a transducer, which transmits or receives electromagnetic waves. Antennas include one or more elements, which are conductors that radiate the electromagnetic waves (radiators). When transmitting, an alternating current is created in the element(s) by application of a voltage at the terminals of the antenna, which causes the element(s) to radiate an electromagnetic field. When receiving, an electromagnetic field from a remote source induces an alternating current in the elements generating a corresponding voltage at the terminals of the antenna.

The orientation of the electric field of the radio wave with respect to the Earth's surface is called the polarization of an antenna. Polarization of an antenna is typically determined by the physical structure and orientation of the antenna. For example, a straight wire antenna may have one polarization when mounted vertically, and a different polarization when mounted horizontally. In other words, polarization is the sum of the E-plane orientations over time projected onto an imaginary plane perpendicular to the direction of motion of the radio wave. In some cases, polarization may be elliptical (the projection is oblong), meaning that the antenna varies over time in the polarization of the radio waves it is emitting. In other cases, polarization may be linear (the ellipse collapses into a line), or circular (in which the ellipse varies maximally). In linear polarization the antenna compels the electric field of the emitted radio wave to a particular orientation, such as horizontal and vertical polarization. Alternatively, polarization may be circular, in which the antenna continuously varies the electric field of the radio wave through all possible values of its orientation with regard to the Earth's surface.

In practice, it is important that linearly polarized antennas be matched to substantially reduce the received signal strength requirement. Accordingly, a horizontal polarization works best with a substantially horizontal polarization antenna and vertical polarization antenna works best with a substantially vertical polarization antenna. Intermediate matchings will lose some signal strength, but not as much as a complete mismatch.

Furthermore, because the electro-magnetic wave travels through different parts of the antenna system (radio, feed line, antenna, free space, etc.), it may encounter differences in impedance. At each interface, depending on how well the impedance is matched, some portion of the wave's energy reflects back to the source of the wave, forming a standing wave in the feed line. Impedance matching deals with minimizing impedance differences at each interface to reduce ratio of maximum power to minimum power, that is, the standing wave ratio (SWR), and to maximize power transfer through each part of the antenna system.

Complex impedance of an antenna is related to the electrical length of the antenna at the wavelength in use. The impedance of an antenna can be matched to the feed line and radio by adjusting the impedance of the feed line, for example, by adjusting the length and width of the feed line.

Many antenna applications require broadband, dual polarized antenna elements to transmit and/or receive a diverse number of polarizations and hence the receiver antenna must be able to handle multiple polarizations. Moreover, sometimes the sensor location does not easily lend itself to providing a particular polarization, like an element that is located 60 degrees off center on a cylinder yet needs to be able to transmit and/or receive a horizontally polarized signal. Furthermore, many antenna applications do not have much depth requiring conformal mounting and collocation of the orthogonally polarized antennas.

Prior attempts to solve the above mentioned problems include a quad-notch in a cavity. The quad-notch in a cavity offers two orthogonal polarizations that is broadband (~9:1) and high gain. However, the cavity and antenna require a large amount of space (approximately 12×12×3 inches deep for a 2-18 GHz antenna), which is too large for some applications. A conventional conformal channel monopole provides a thin (approximately 2×1×0.025 for a 2-18 GHz antenna), conformal antenna that is also broadband (~9:1). However, it only provides one polarization at any given location. On the other hand, antennas with ultra-wide bandwidth have usually been too large to consider for many applications, such as antenna arrays.

SUMMARY OF THE INVENTION

In some embodiments, the present invention provides a polarization diverse antenna within the physical volume of a standard conformal channel monopole (for example, ~0.25 inches of depth for a 2-18 GHz antenna). The invention allows for an antenna in which one can obtain two orthogonal polarizations simultaneously or even more than two polarizations simultaneously if desired. This makes the invention suitable for any application or platform that requires the small size and moderate gain that a conformal channel monopole supplies.

In some embodiments, the present invention is a conformal channel monopole antenna system. The antenna system includes: a housing having a top surface; a cavity formed within the housing; and a substrate covering the cavity. The substrate includes a first elongated radiating element coupled to two opposing sides of the top surface of the housing at two opposing ends in a first direction; a second elongated radiating element coupled another two opposing sides of the top surface of the housing at two opposing ends in a second direction orthogonal to the first direction; a first feed port at one end of the first elongated radiating element; and a second feed port at one end of the second elongated radiating element. The first elongated radiating element is configured to radiate a first type of polarization and the second elongated radiating element is configured to radiate a second type of polarization simultaneously with the first type of polarization.

In some embodiments, the present invention is a conformal channel monopole antenna system including a housing having a top surface; a cavity formed within the housing; and a substrate covering the cavity. The substrate includes a first radiating element having a first end and a second end, the first end in proximity of a first side of the top surface and the second end in proximity of a center of the top surface; a second radiating element rotated by a first angle from the first radiating element and having a first end and a second end, the first end in proximity of a second side of the top surface and the second end in proximity of the center of the top surface; a third radiating element rotated by a second angle from the second radiating element and having a first end and a second end, the first end in proximity of a third side of the top surface and the send end in proximity of the center of the top surface. The second ends of the first, second and third radiating elements are connected together at proximity of the center of the top surface. The substrate further includes a first feed port at the first end of the first radiating element; a second feed port at the first end of the second radiating element; and a third feed port at the first end of the third radiating element. The first radiating element is configured to radiate a first type of polarization and the second and third radiating element are configured to radiate a second type of polarization simultaneously with the first type of polarization.

DETAILED DESCRIPTION

In some embodiments, the present invention is a channel monopole antenna, which includes two orthogonal polarizations in a small, thin, conformal space. More than two polarizations are also possible by increasing the number of monopoles. For example, for a 2-18 GHz antenna, the antenna would nominally fit inside a space 2×2×0.25 inches deep. Also, the invention provides both polarizations simultaneously via separate ports for each polarization. In addition, the invention can be designed for multiple linear polarizations that can all be sensed simultaneously, which could be advantageous for many applications.

Figure 1:
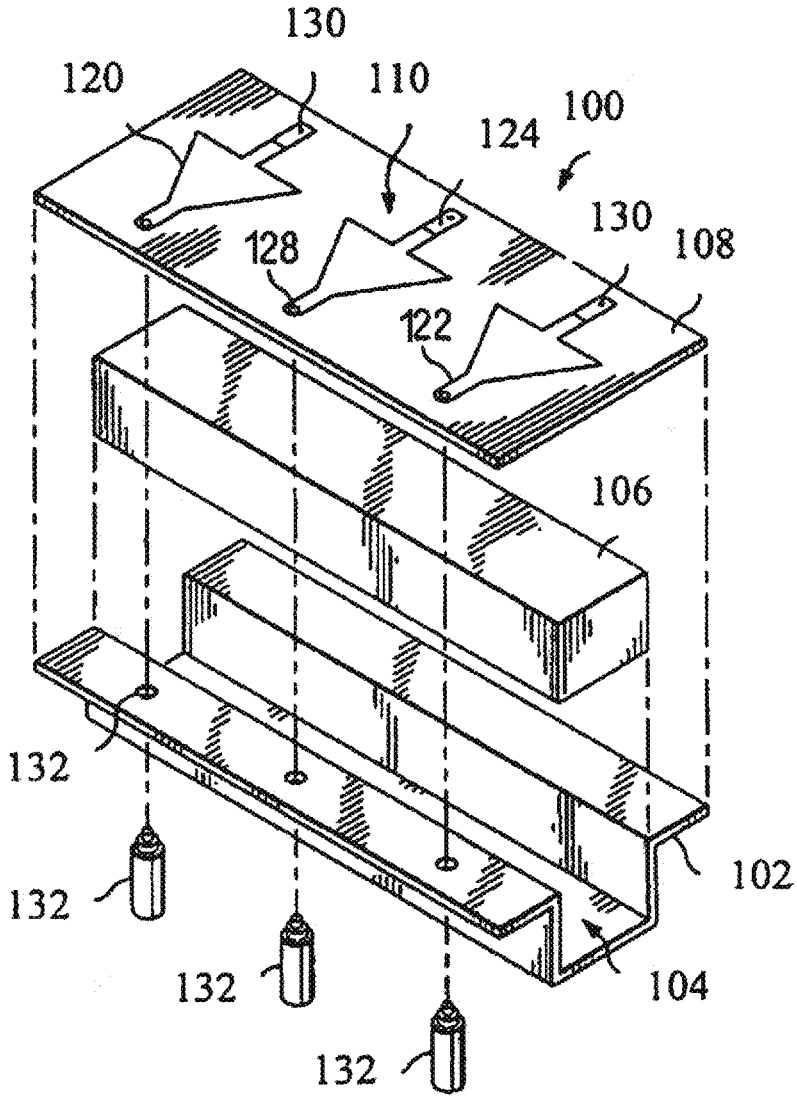
FIG. 1 is an exploded perspective view of a conventional antenna.

FIG. 1 is an exploded perspective view of a conventional channel monopole antenna. Antenna 100 includes a substrate 108 having a plurality of radiating elements 110 formed therein. Radiating elements 110 include a radiating portion 120, a feed line 122, and a resistive end load 124. Although, in the illustrated FIG. 1, the shape of radiating portion 120 is triangular, radiating portion 120 may have any suitable shape, such as triangular, rectangular and elliptical, according to the design of the antenna. The function of radiating portion 120 is to radiate signals received through feed line 122.

Radiating portion 120 couples to feed line 122, which may have any suitable length and any suitable shape. Feed line 122 includes a contact via 128 that couples to a respective coaxial cable 132 in order to receive signals. Resistive end load 124 may also have any suitable size and shape and may couple to radiating portion 120 in any suitable manner. Resistive end loads 124 generally function to absorb the ringing caused by the residual energy of antenna 100. A suitable choice of resistor provides low voltage standing wave ratio (VSWR) over the operating bandwidth for antenna 100. Resistivity of resistive end load 124 is normally chosen to minimize VSWR while maximizing the radiating efficiency. Typically, resistance should be larger than the characteristic impedance of feed line 122. However, if VSWR and bandwidth requirements allow, it may have zero resistivity.

As shown, resistive end load 124 includes a grounding pin 130 that couples to base plate 102. In order to couple coaxial cables 132 to respective feed lines 122, a plurality of apertures 134 may be formed in base plate 102. Base plate 102 includes a continuous channel 104 that is electrically conducting. In the case of a single element antenna, the cavity of the antenna would be the channel. Antenna 100 may also have a dielectric material 106 within channel (cavity) 104. A radome (not illustrated), which is a shell transparent to radio-frequency radiation and typically used to house a radar antenna may also be associated with antenna 100. Although, the components of antenna 100 are shown as flat planes, they may be shaped to conform to a curve shaped medium.

Figure 2:
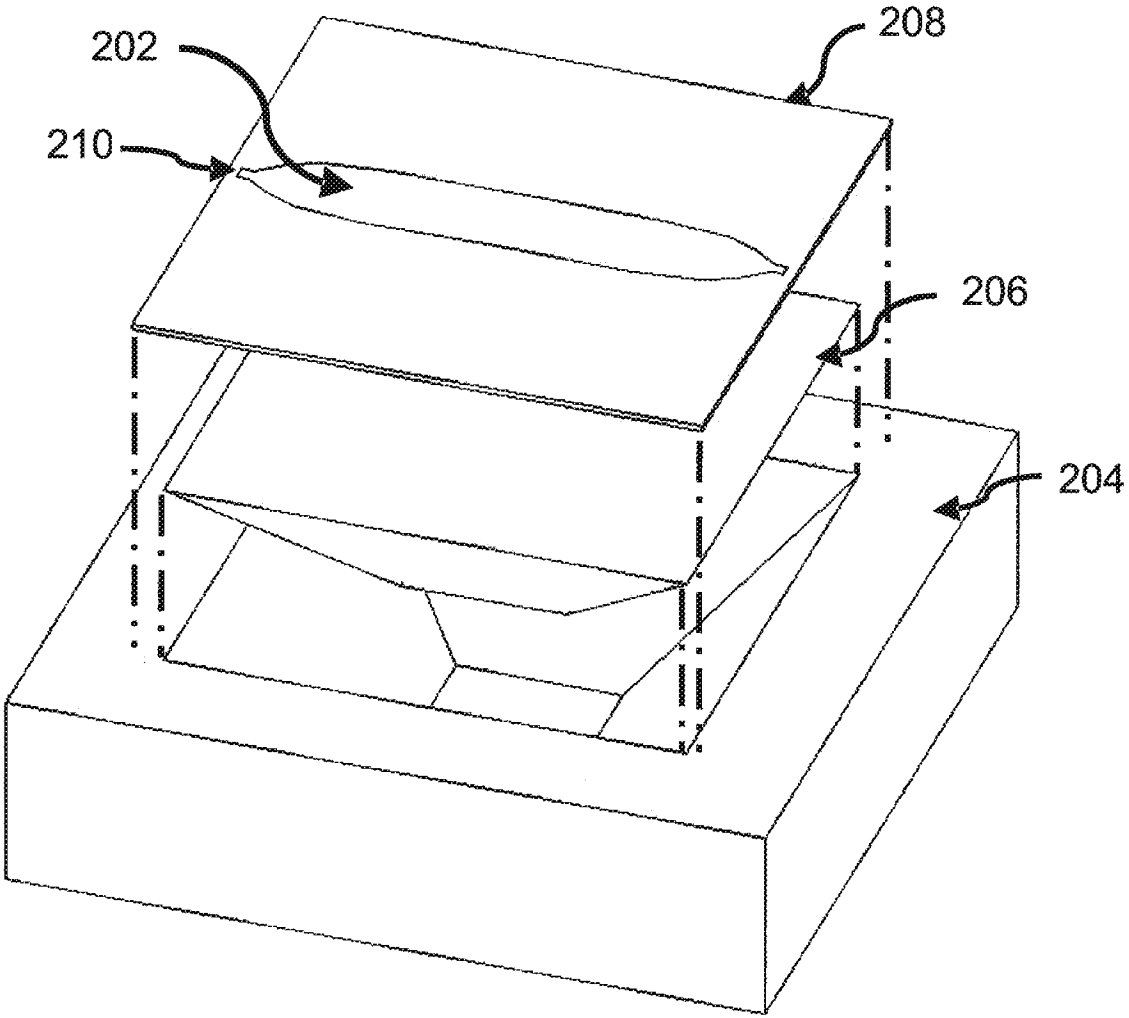
FIG. 2 shows an exploded perspective of a typical antenna element that is conformal to the housing.

FIG. 2 shows a typical single channel monopole antenna element 202 that is conformal to the housing 204 with minimal intrusion. In this case, channel monopole radiates in one linear polarization. The housing (box) 204 is typically a metal box, which includes a cavity 206 therein. A circuit board layer (substrate) 208 is formed on the metal housing to accommodate the antenna element trace, and other electronic circuitry, if desired. The antenna element 202 is formed on the circuit board layer 208. A feed line 210 is provided to receive signals.

Figure 3:
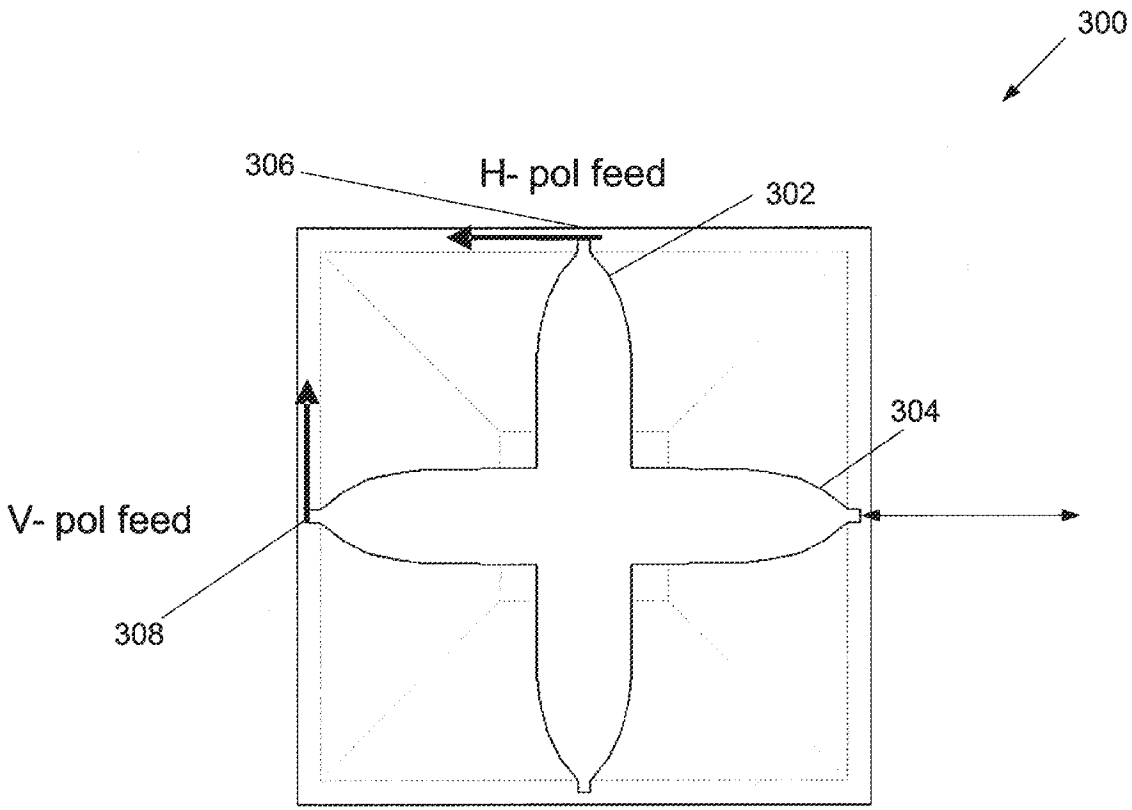
FIG. 3 shows an exemplary conformal channel monopole antenna, according to some embodiments of the present invention.

FIG. 3 shows a top down view of an exemplary conformal channel monopole antenna 300, according to some embodiments of the present invention. Most of the structural elements of the conformal channel monopole antenna 300, such as the housing (box) 204, the cavity 206, and the board layer (substrate) 208, are similar to those of the antenna element 202 shown in FIG. 2. However, antenna 300 is formed by placing another monopole 304 radiator that is rotated by 90° on the circuit board layer 208. The added monopole radiator 304 is joined to the original monopole 302 radiator.

As shown, the substrate 308 covering the cavity includes a first elongated radiating element 302 (monopole) coupled to two opposing sides of the top surface of the housing at two opposing ends in a first direction, and a second elongated radiating element 304 (monopole) coupled another two opposing sides of the top surface of the housing at two opposing ends in a second direction orthogonal to the first direction. A first feed port 306 is located at one end of the first elongated radiating element and a second feed port 308 is located at one end of the second elongated radiating element. Here, the first elongated radiating element is configured to radiate a first type of polarization (for example, vertical polarization) and the second elongated radiating element is configured to radiate a second type of polarization (for example, horizontal polarization) simultaneously with the first type of polarization In this embodiment, the antenna 300 includes two feed lines 306 and 308 on either end of monopoles 302 and 304, respectively. Here, each monopole 302 and 304 radiates linear polarization. For example, the horizontal monopole 302 radiates vertical polarization and the vertical monopole 304 radiates horizontal polarization. Although, there are two feed lines 306 and 308 on either end of monopoles 302 and 304, respectively, it is possible to have two more feed lines, at the other two ends of the monopoles 302 and 304, that is a total of four feed lines. If there are no feed lines at any end of the monopoles, these ends need to be terminated with resistive elements to maximize the impedance match.

Figure 4:
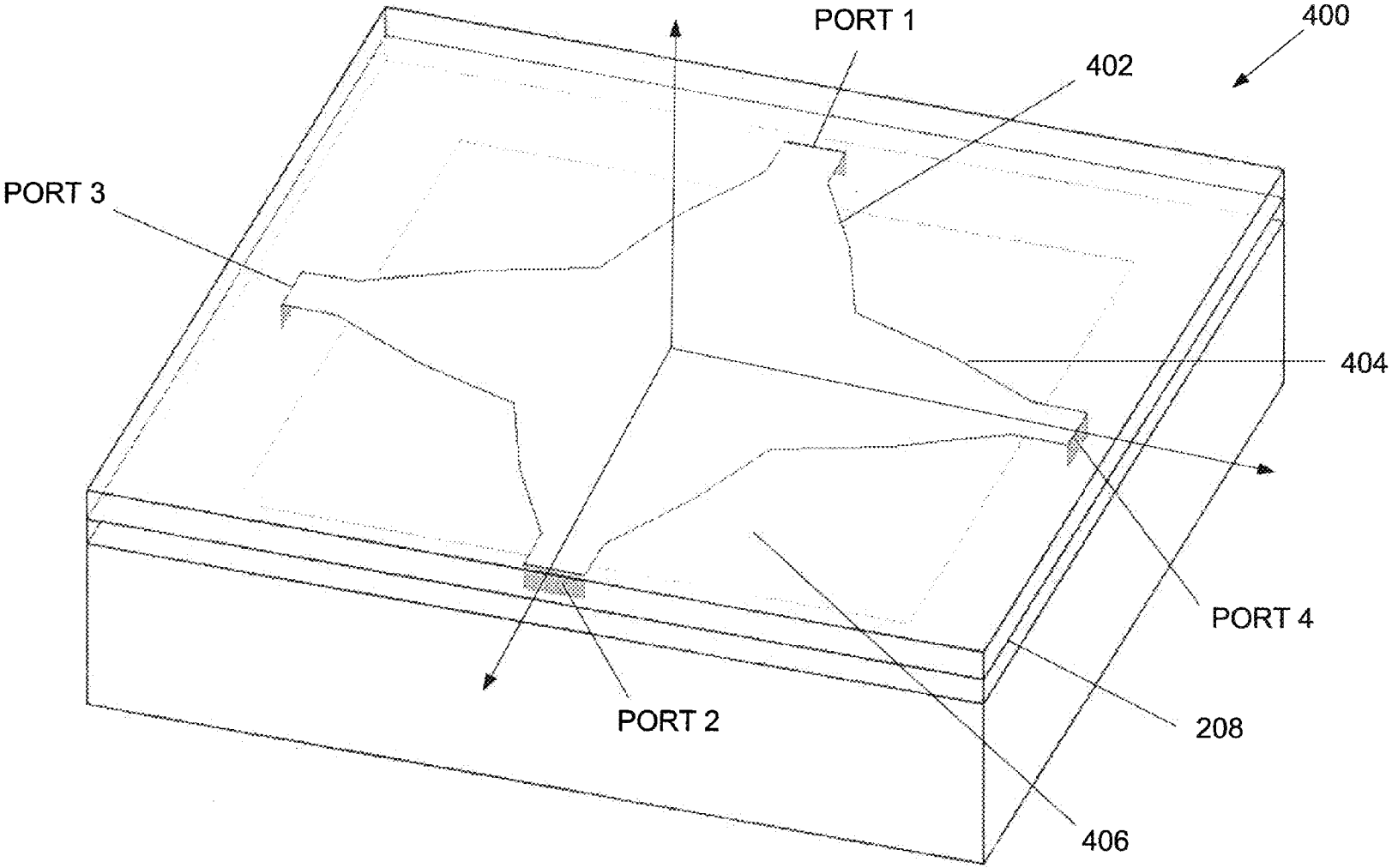
FIG. 4 shows an exemplary conformal channel monopole antenna, according to some embodiments of the present invention.

FIG. 4 shows an exemplary conformal channel monopole antenna 400, according to some embodiments of the present invention. Again, most of the structural elements of the conformal channel monopole antenna 400, such as the housing (box) 204, and the board layer (substrate) 208, are similar to those of the dual-pol antenna element 202 shown in FIG. 2. However, antenna 400 is formed by placing two elliptically shaped traces for the radiators 402 and 404. In some embodiments, the size of the cavity 406 is 0.75×0.75×0.20 inches deep with a 45° slope in the walls of the cavity 406. The traces for the monopole radiators 402 and 404 are formed on the board layer 208. In some embodiments, the trace tapers from a 50 ohm microstrip line to 0.20 inches at its widest point. The width of the trace defines how well the impedance of the antenna 400 is matched to the feed lines. In this case, there are four ports for dual feeding of the antenna. That is, the monopole radiator 402 can be fed from port 1 or port 2. Similarly, the monopole radiator 404 can be fed from port 3 or port 4.

In this case, ports 1 and 2 provide vertical polarization and ports 3 and 4 provide horizontal polarization. Here, port 2 provides the mirror of the pattern provided by port 1. Furthermore, Ports 3 and 4 give the same response for horizontal polarization except that the patterns are rotated 90° about the antenna's normal. In this embodiment, as the frequency increases, the pattern becomes more directive toward grazing. The transition between a more omni pattern and a directive pattern occurs around when the cavity length becomes 0.5×, where λ is the wavelength of the received/transmitted signal.

Figure 5A:
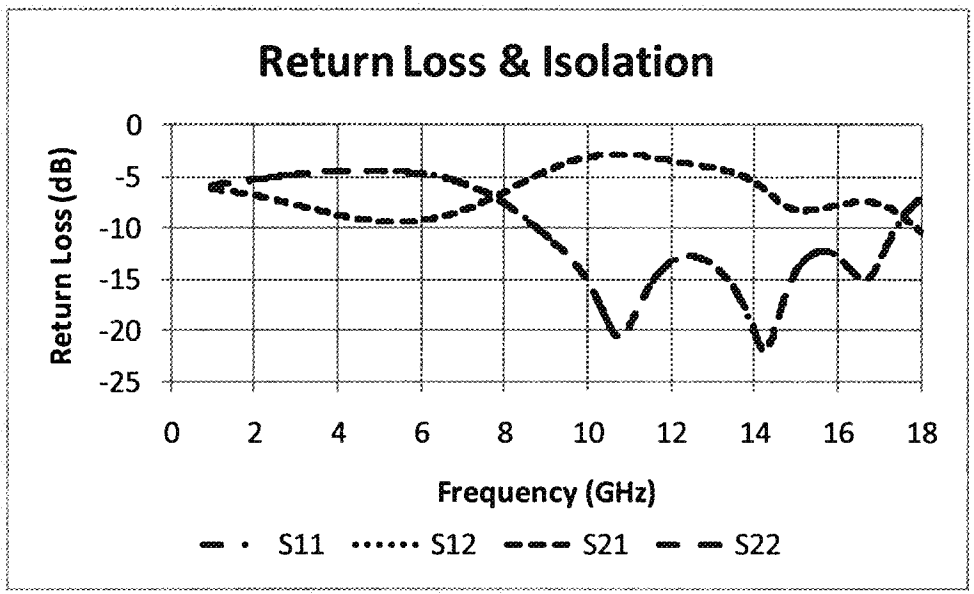
FIGS. 5A to 5C are plots depicting the Return Loss, efficiency and average gain versus frequency for the antenna of FIG. 4.
Figure 5B:
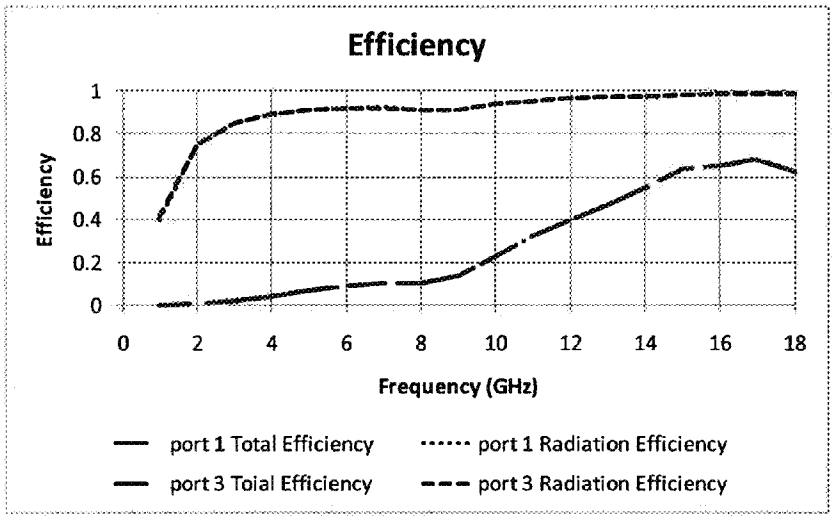
Figure 5C:
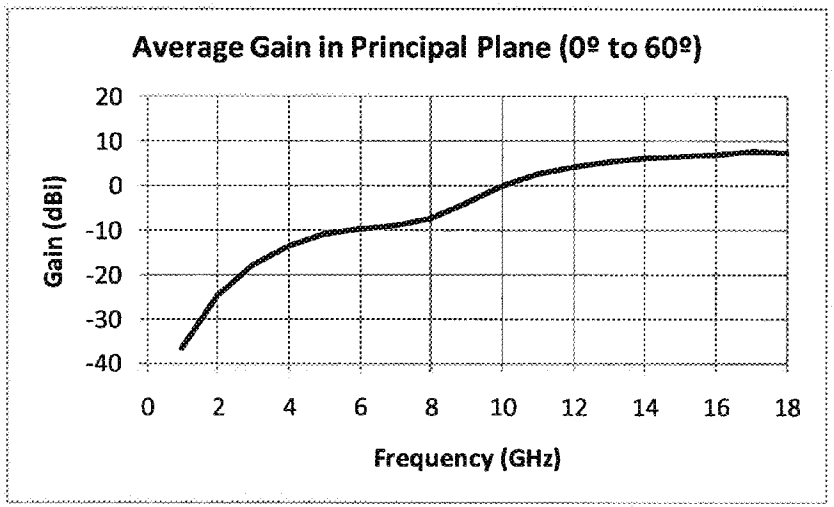

FIGS. 5A to 5C are plots depicting the Return Loss, efficiency and average gain versus frequency for the antenna 400 of FIG. 4. As shown in FIG. 5A, the conformal channel monopole antenna 400 results in an efficient antenna with minimal energy going into the other ports. The match and isolation of the conformal channel monopole antenna 400 improve as the length of the cavity 406 and traces 402 and 404 become greater than 0.50λ.

As shown in FIGS. 5B and 5C, as frequency increases and the length of the cavity 406 and feed lines become greater than 0.5λ, the efficiency and gain of the antenna 400 start to dramatically increase. However, there appears to be a limit to the increase in efficiency and gain in that when the cavity and feed become equal to or greater than λ, then the gain and efficiency begin to slowly decrease.

Figure 6:
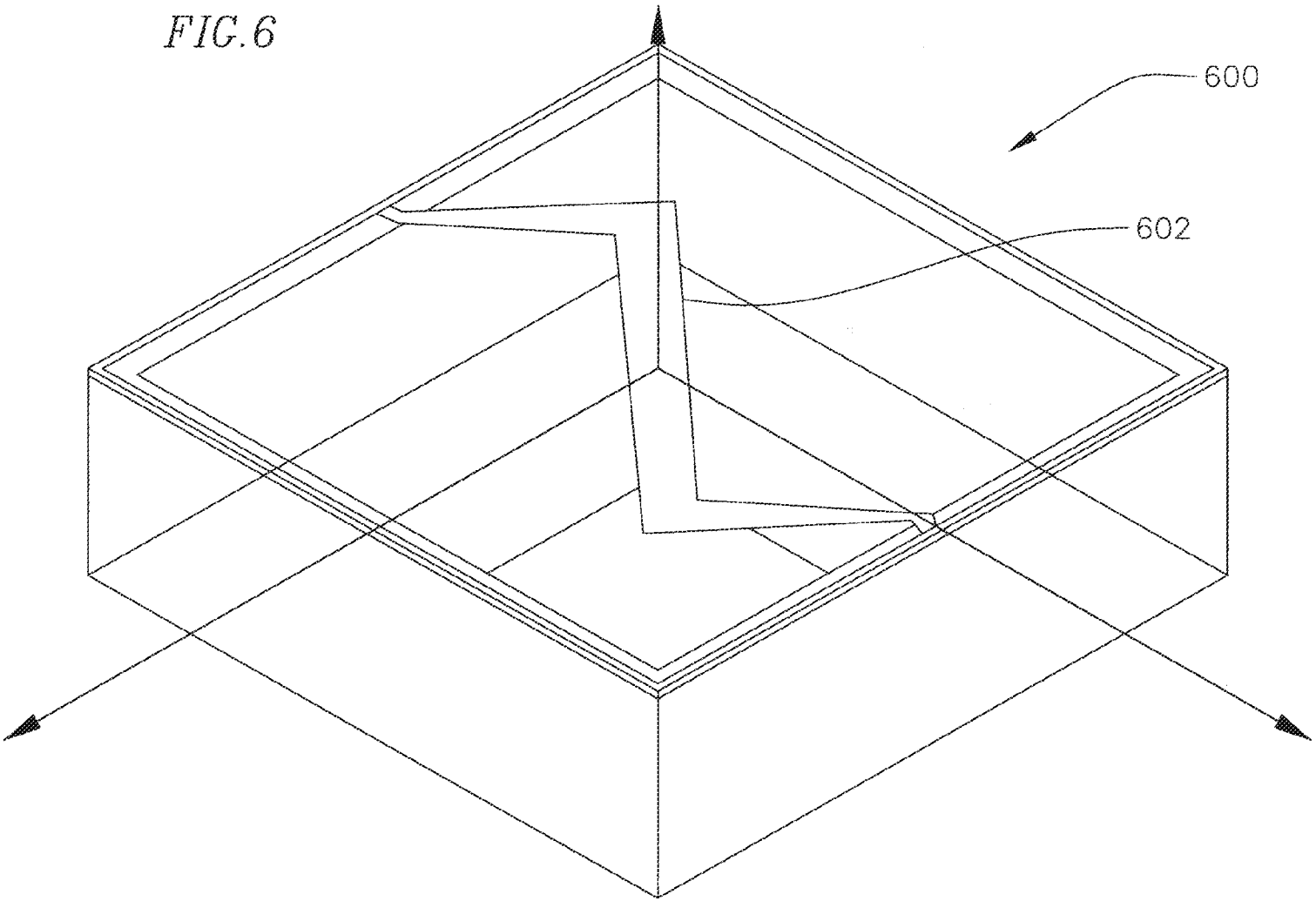
FIG. 6 shows an exemplary two port conformal channel monopole antenna, according to some embodiments of the present invention.

FIG. 6 shows an exemplary two port conformal channel monopole antenna 600, in which the monopole 602 is meandered in a zigzag or sinewave shape, according to some embodiments of the present invention. Although, the monopole is shown in a zigzag shape, it can also be in a sinewave shape. This pattern changes the polarization sensed at the feeds from linear to an elliptical polarization. That is, changing the shape and path of the monopole affects the polarization of the antenna. In some embodiments, another zigzag or sinewave shaped monopole is added to provide two simultaneous elliptical polarizations. By shaping the monopoles right, in this case, meandering them in a sine wave pattern, one can generate a circular polarized antenna that is fed from one port.

Accordingly, monopoles can be spaced a given angular distance to simultaneously provide a certain number of polarizations. A single element capable of sensing multiple polarizations simultaneously for direction finding (DF) applications can easily be designed. It is noted that the conventional channel monopole shown in FIG. 1 and FIG. 2 is a special case of this antenna in which there is a single monopole and single feed. Finally, as with the conventional conformal channel monopole, the antenna feeds (or monopoles) can be easily fabricated out of circuit cards with standard procedures, which makes the construction of the antenna simple.

Figure 7:
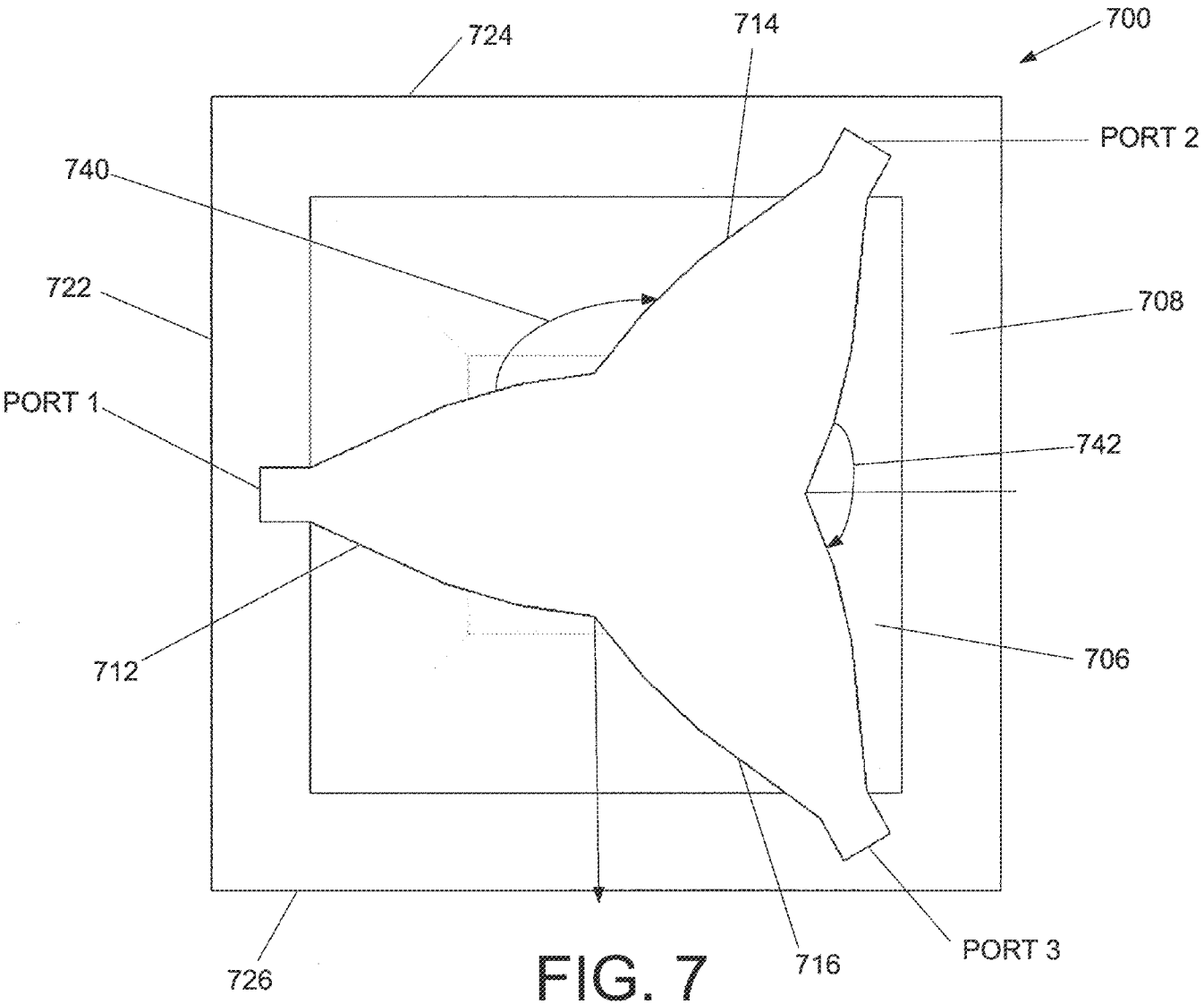
FIG. 7 shows an exemplary three port conformal channel monopole antenna, according to some embodiments of the present invention.

FIG. 7 shows an exemplary three port conformal channel monopole antenna 700, according to some embodiments of the present invention. In this embodiment, one of the feeds from the antenna 400 in FIG. 4 is eliminated resulting in a three port conformal channel monopole antenna 700. In this embodiment, port 1 provides one linear polarization, and ports 2 and 3, which are fed 180° out of phase provide the orthogonal polarization. Different arrangement of the angle of the monopole or different feed signal relationship provides different polarizations. For example, if the three arms were oriented so that the first min (port 1) was oriented as shown in FIG. 7 and the other arms were angled ±135° from the first arm, then the first arm would sense vertical polarization, and the second and third arms would sense +45° slant polarization and −45° slant polarization, respectively. In order to form horizontal polarization, the second and third arms are fed 180° out of phase. If the second and third arms are fed in phase, then they would provide vertical polarization. This embodiment reduces the number of connectors by 25%.

As shown in FIG. 7, substrate 708 covering the cavity 706 includes a first radiating element 712 having a first end being in proximity of a first side 722 of the top surface and a second end in proximity of a center of the top surface. The substrate 708 further includes a second radiating element 714 rotated by a first angle 740 from the first radiating element 712 and having a first end in proximity of a second side 724 of the top surface and a second end in proximity of the center of the top surface. The substrate 708 additionally includes a third radiating element 716 rotated by a second angle 742 from the second radiating element 714 and having a first end in proximity of a third side 726 of the top surface and a send end in proximity of the center of the top surface. The second ends of the first, second and third radiating elements are connected (meshed) together at proximity of the center of the top surface. The three port conformal channel monopole antenna 700 further includes a first feed port (PORT 1) at the first end of the first radiating element, a second feed port (PORT 2) at the first end of the second radiating element, and a third feed port (PORT 3) at the first end of the third radiating element. Here, the first radiating element is configured to radiate a first type of polarization and the second and third radiating element are configured to radiate a second type of polarization simultaneously with the first type of polarization.

Figure 8:
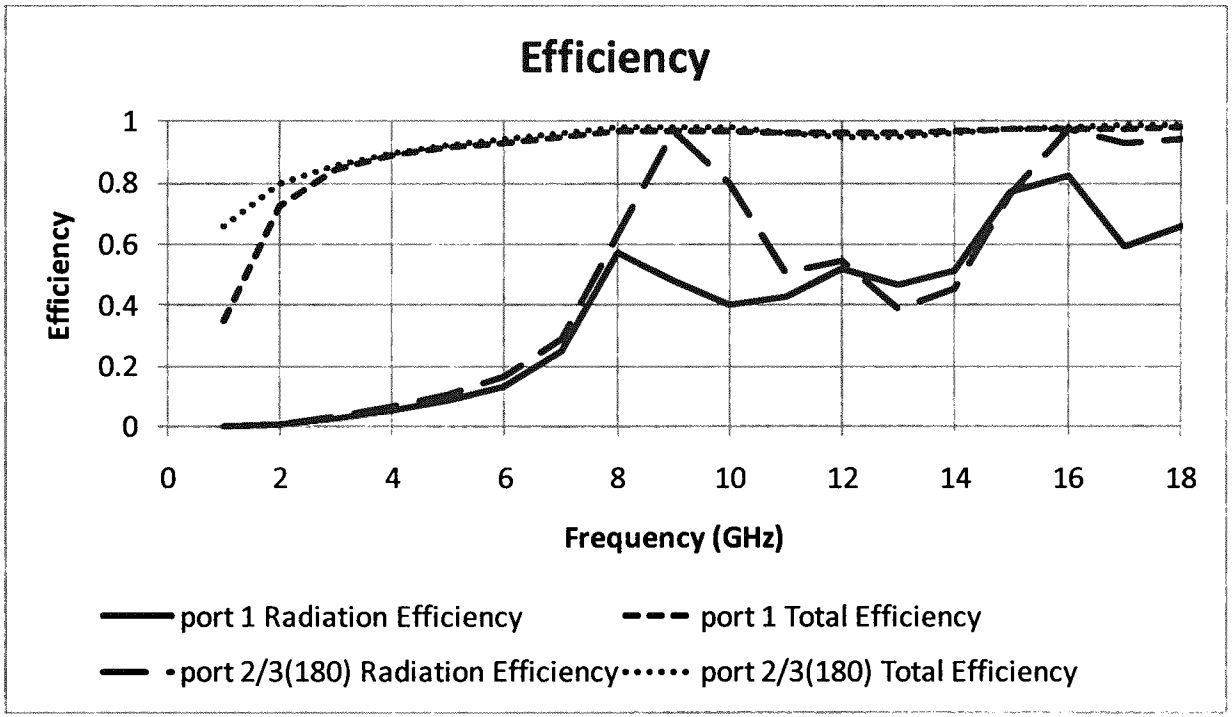
FIG. 8 is a plot depicting the efficiency versus frequency for the antenna of FIG. 7.

Simulation results show that this embodiment has similar gain and pattern performance to the conformal channel monopole antenna 400 shown in FIG. 4. However, the efficiency results, shown in FIG. 8, show that the overall efficiency of this embodiment is greater than the overall efficiency of the four-feed design, shown in FIG. 5B. As seen in FIG. 8, ports 2 and 3 fed 180° out of phase shows a dramatic improvement in efficiency at various frequencies (~100%), which occurs around where the length of the cavity approaches 0.5λ.

The gain patterns for ports 2 and 3 with a 180° phase shift provide higher peak gain and efficiency compared to the peak gain and efficiency from port 1, which is caused by using two ports rather than one port because of the increase in effective aperture area using the two monopoles versus the smaller effective aperture area using only one monopole. Other variation to this tri-pole embodiments are possible. For example, a three-port polarization diverse channel monopole, in which each port provides a linear polarization. That is, the combination of two of the ports with the appropriate phasing of the feed signals synthesizes a different polarization.

Longer monopoles and cavities will provide more directive patterns and higher peak gain, according to embodiments of the present invention. In general, an optimum size of the cavity and traces for high efficiency is a length greater than 0.5λ. In addition, as with the channel monopole, the opposite ends can be either feeds or resistive terminations depending on the application. Resistive terminations tend to provide higher gain and better match.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A conformal channel monopole antenna system comprising:

a housing having a top surface;

a cavity framed within the housing; and a substrate on the housing and placed on top of the cavity, and having a top surface, the substrate-including a first elongated radiating element trace formed on the top surface of the substrate by a first conductive trace and coupled to two opposing sides of the top surface of the housing at two opposing ends in a first direction, wherein the first elongated radiating element has a narrower shape at its two opposing ends than its center;

a second elongated radiating element trace formed on the top surface of the substrate by a second conductive trace and coupled to another two opposing sides of the top surface of the housing at two opposing ends in a second direction orthogonal to the first direction, wherein the second elongated radiating element has a narrower shape at its two opposing ends than its center;

a first feed port directly connected to one end of the first elongated radiating element trace; and a second feed port directly connected to one end of the second elongated radiating element trace, wherein the first elongated radiating element trace is configured to radiate a first type of polarization and the second elongated radiating element trace is configured to radiate a second type of polarization simultaneously with the first type of polarization, and wherein the first elongated radiating element trace and the second elongated radiating element trace are configured to form said monopole antenna system.

2. The antenna system of claim 1, wherein the first type of polarization is a vertical polarization and the second type of polarization is a horizontal polarization.

3. The antenna system of claim 1, wherein the first type of polarization is a first elliptical polarization and the second type of polarization is a second elliptical polarization.

4. The antenna system of claim 1, wherein the first elongated radiating element and the second elongated radiating element have substantially sinewave shapes.

5. The antenna system of claim 1, wherein the first elongated radiating element and the second elongated radiating element have substantially elliptical shapes.

6. The antenna system of claim 1, wherein the first and second feed ports are fed by a same signal.

7. The antenna system of claim 1, wherein the first feed port is fed by a first signal and the second feed port is fed by a second signal having a phase relationship to the first signal.

8. The antenna system of claim 1, wherein the cavity has four side walls with a 45° slope with respect to the top surface of the housing.

9. The antenna system of claim 1, wherein the housing is a metal box.

10. The antenna system of claim 1, wherein the first and second elongated radiating elements are each a microstrip.

11. The antenna system of claim 10, wherein the first and second elongated radiating elements each taper from a 50 ohm microstrip line to approximately 0.20 inches at their widest point.

12. The antenna system of claim 1, further comprising a third feed port at the other end of the first elongated radiating element; and a fourth feed port at the other end of the second elongated radiating element.

13. The antenna system of claim 1, wherein the other end of the first elongated radiating element and the other end of the second elongated radiating element are terminated with resistive elements.

* * * * *